US012345480B2

(12) United States Patent
Chung et al.

(10) Patent No.: US 12,345,480 B2
(45) Date of Patent: Jul. 1, 2025

(54) COOLING DEVICE FOR HEAT TREATMENT

(71) Applicants: DONGWOO HST CO., LTD., Asan-si (KR); Winner vacuum Solution Co., Ltd., Siheung-si (KR)

(72) Inventors: Soo Jin Chung, Seoul (KR); Won Ki Chung, Seoul (KR); Jun Yong Park, Seoul (KR); Young Min Shin, Namyangju-si (KR); Hyeon Seung Lee, Ansan-si (KR)

(73) Assignee: DONGWOO HST CO., LTD., Siheung-si (KR)

( * ) Notice: Subject to any disclaimer, the term of this patent is extended or adjusted under 35 U.S.C. 154(b) by 0 days.

(21) Appl. No.: 18/532,517

(22) Filed: Dec. 7, 2023

(65) Prior Publication Data

US 2024/0219130 A1 Jul. 4, 2024

(30) Foreign Application Priority Data

Dec. 29, 2022 (KR) ..... 10-2022-0189887

(51) Int. Cl.
*F28F 25/06* (2006.01)
*C21D 1/667* (2006.01)
(Continued)

(52) U.S. Cl.
CPC ..... *F28F 25/06* (2013.01); *C21D 1/667* (2013.01); *F28F 5/00* (2013.01); *F28F 2025/005* (2013.01); *F28F 2280/10* (2013.01)

(58) Field of Classification Search
CPC ..... F28F 25/06; F28F 5/00; F28F 2025/005; F28F 2280/10; C21D 1/667
(Continued)

(56) References Cited

U.S. PATENT DOCUMENTS 8,945,411 B2 2/2015 Iwai
2012/0028202 A1 2/2012 Katsumata
(Continued)

FOREIGN PATENT DOCUMENTS

CN 205099723 U 3/2016
CN 109022721 A 12/2018
(Continued)

OTHER PUBLICATIONS

Japanese Office Action for JP application No. 2023-198945, dated Nov. 5, 2024, 6 pages.
(Continued)

*Primary Examiner* — Jon T. Schermerhorn, Jr.
(74) *Attorney, Agent, or Firm* — Tarolli, Sundheim, Covell & Tummino LLP

(57) ABSTRACT

The present disclosure relates to a cooling device for heat treatment that performs heat treatment by cooling individually or as a whole a heated metal object. The cooling device for heat treatment includes: a chamber to which a plurality of objects is charged through one open side thereof; an individual cooling unit configured to be provided in the chamber, to individually cover the object, and to spray a cooling medium onto the object; and a driving unit configured to be provided on the chamber and to move the individual cooling unit in an up and down direction. With this configuration, it is possible to obtain a required cooling capacity by cooling individually or as a whole a heated metal object.

12 Claims, 10 Drawing Sheets

(51) Int. Cl.
*F28F 5/00* (2006.01)
*F28F 25/00* (2006.01)

(58) Field of Classification Search
USPC ..... 165/86
See application file for complete search history.

(56) References Cited

U.S. PATENT DOCUMENTS

| | | | | |
|---|---|---|---|---|
| 2023/0121916 | A1* | 4/2023 | Schechner | F04D 29/4226 165/86 |
| 2024/0242972 | A1* | 7/2024 | Inaba | H01L 21/683 |

FOREIGN PATENT DOCUMENTS

| | | | | | |
|---|---|---|---|---|---|
| CN | 114517249 | A | | 5/2022 | |
| DE | 29713958 | U1 | | 10/1997 | |
| JP | 58037118 | A | | 3/1983 | |
| JP | H06-207214 | A | | 7/1994 | |
| JP | 2014111837 | A | | 6/2014 | |
| JP | 5973306 | B2 | | 8/2016 | |
| JP | 2022026824 | A | | 2/2022 | |
| KR | 20100090579 | A | | 8/2010 | |
| KR | 20130065397 | A | | 6/2013 | |
| KR | 20160041017 | A | | 4/2016 | |
| KR | 20210028395 | A | * | 3/2021 | |
| KR | 102315665 | B1 | * | 10/2021 | |
| KR | 102322901 | B1 | * | 11/2021 | |
| TW | 202314825 | A | * | 4/2023 | H01L 21/02 |
| WO | 2004009299 | A2 | | 1/2004 | |
| WO | 2022008599 | A1 | | 1/2022 | |

OTHER PUBLICATIONS

Extended European Search Report (EESR) for corresponding EP Application No. 23215952.5, dated Apr. 8, 2024, 12 pgs.
Office Action for KR application No. 10-2022-0189887, dated May 20, 2025, 5 pages.

* cited by examiner

[FIG. 1]
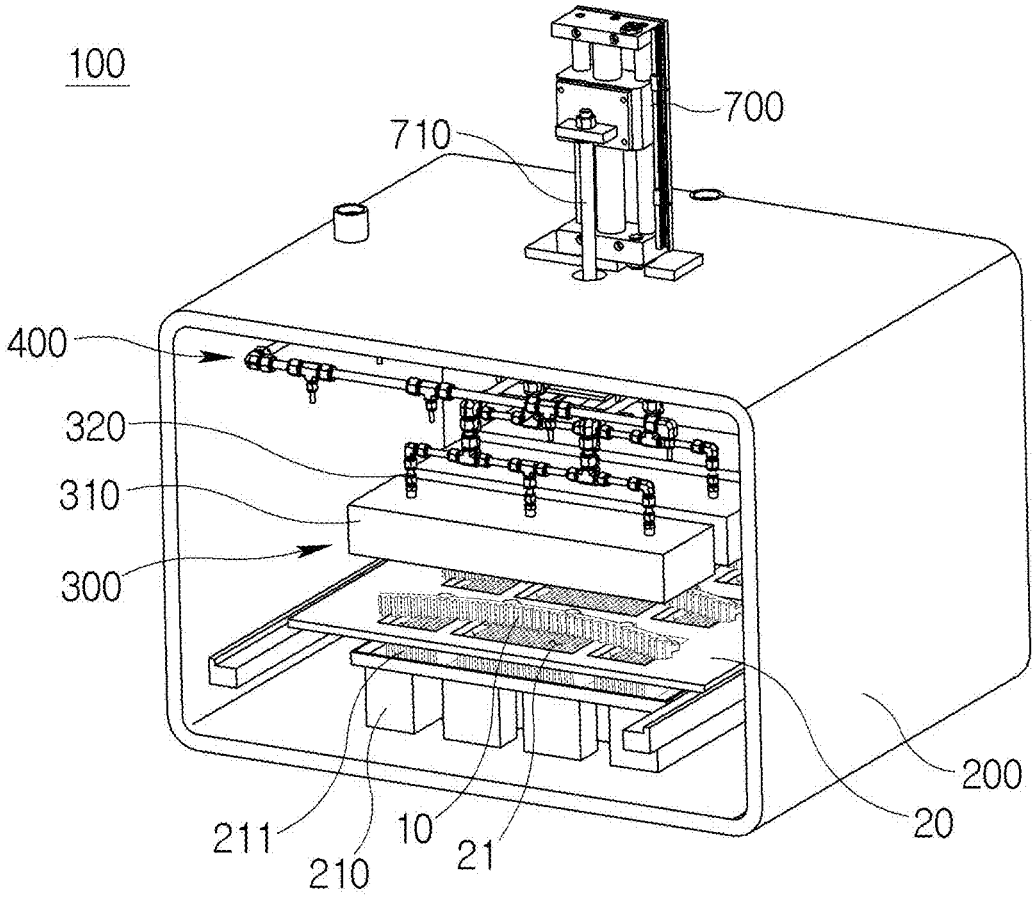

[FIG. 2]
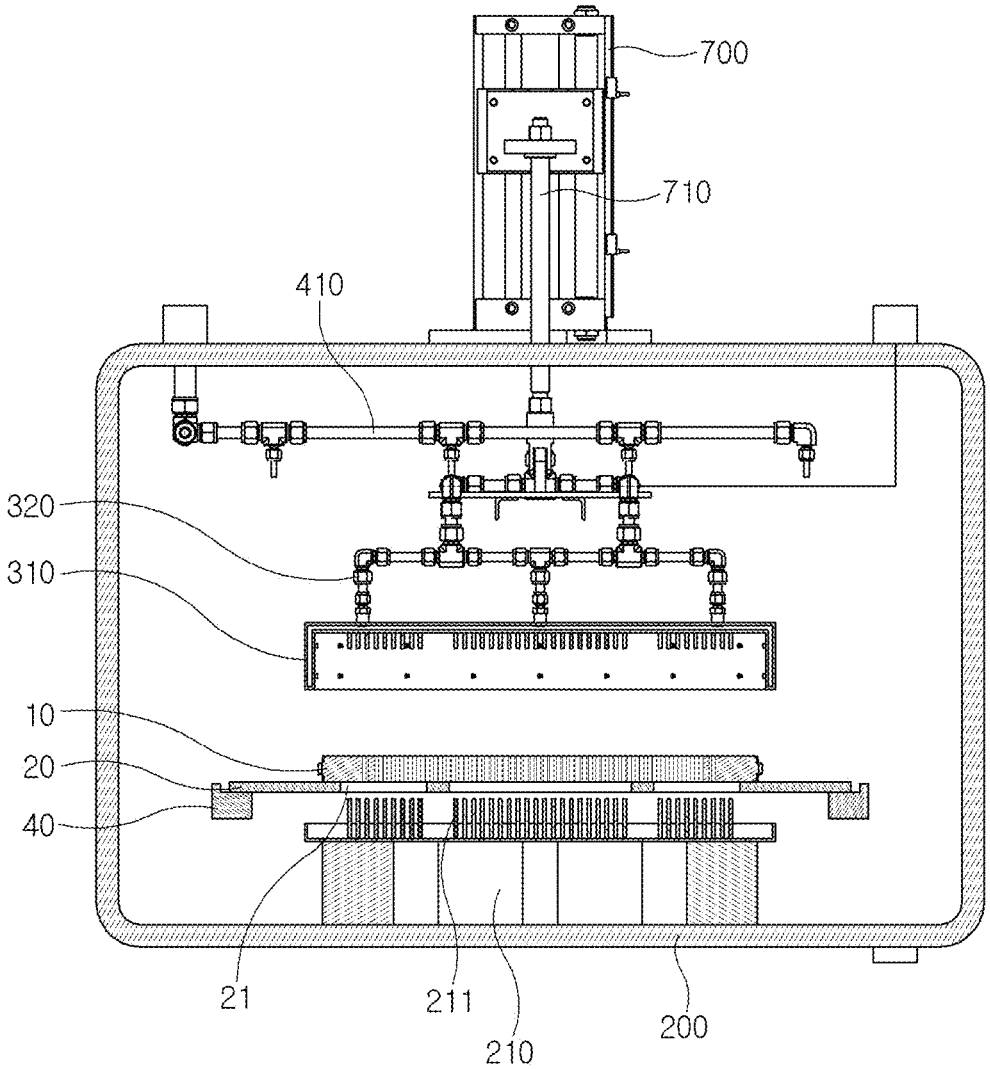

[FIG. 3]
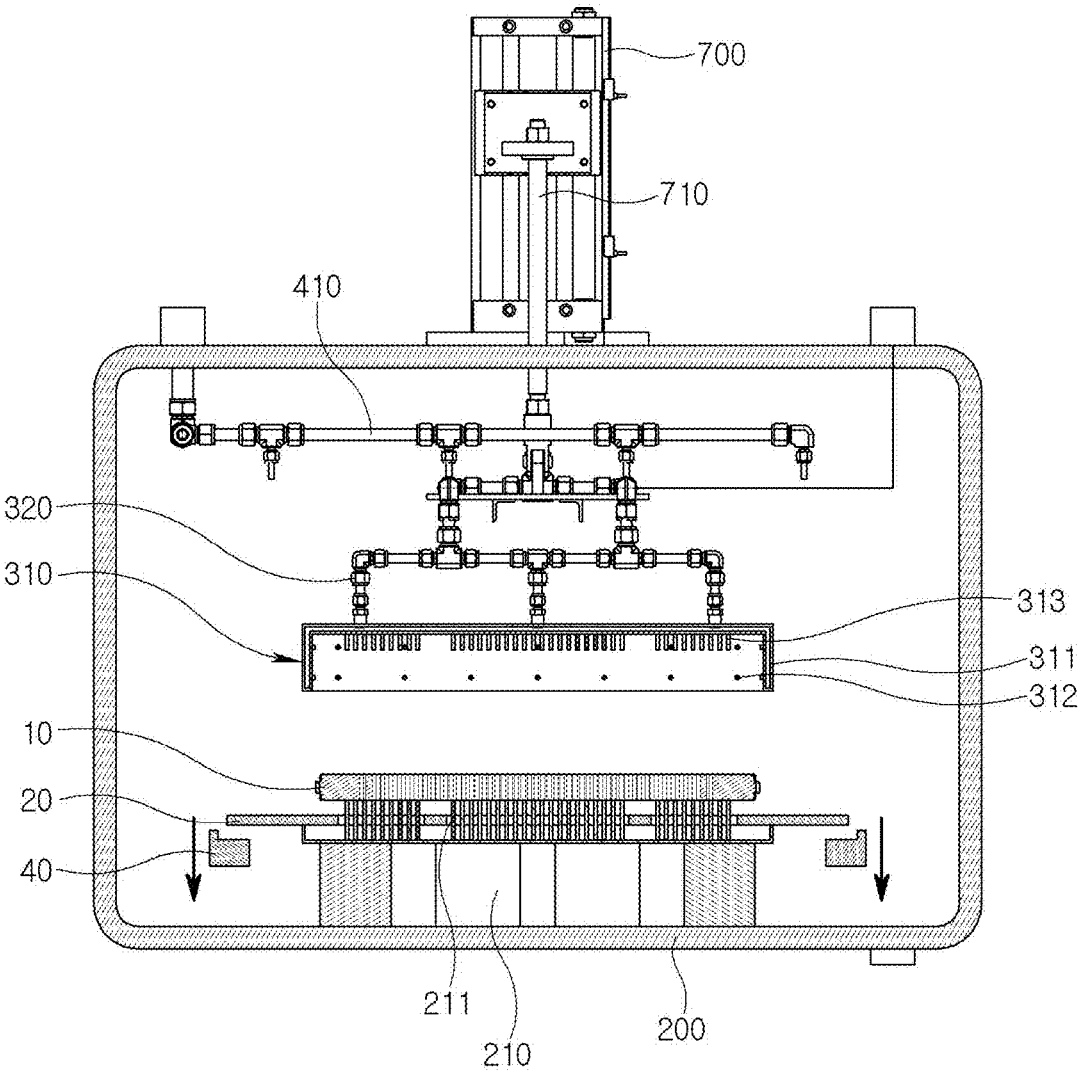

[FIG. 4]
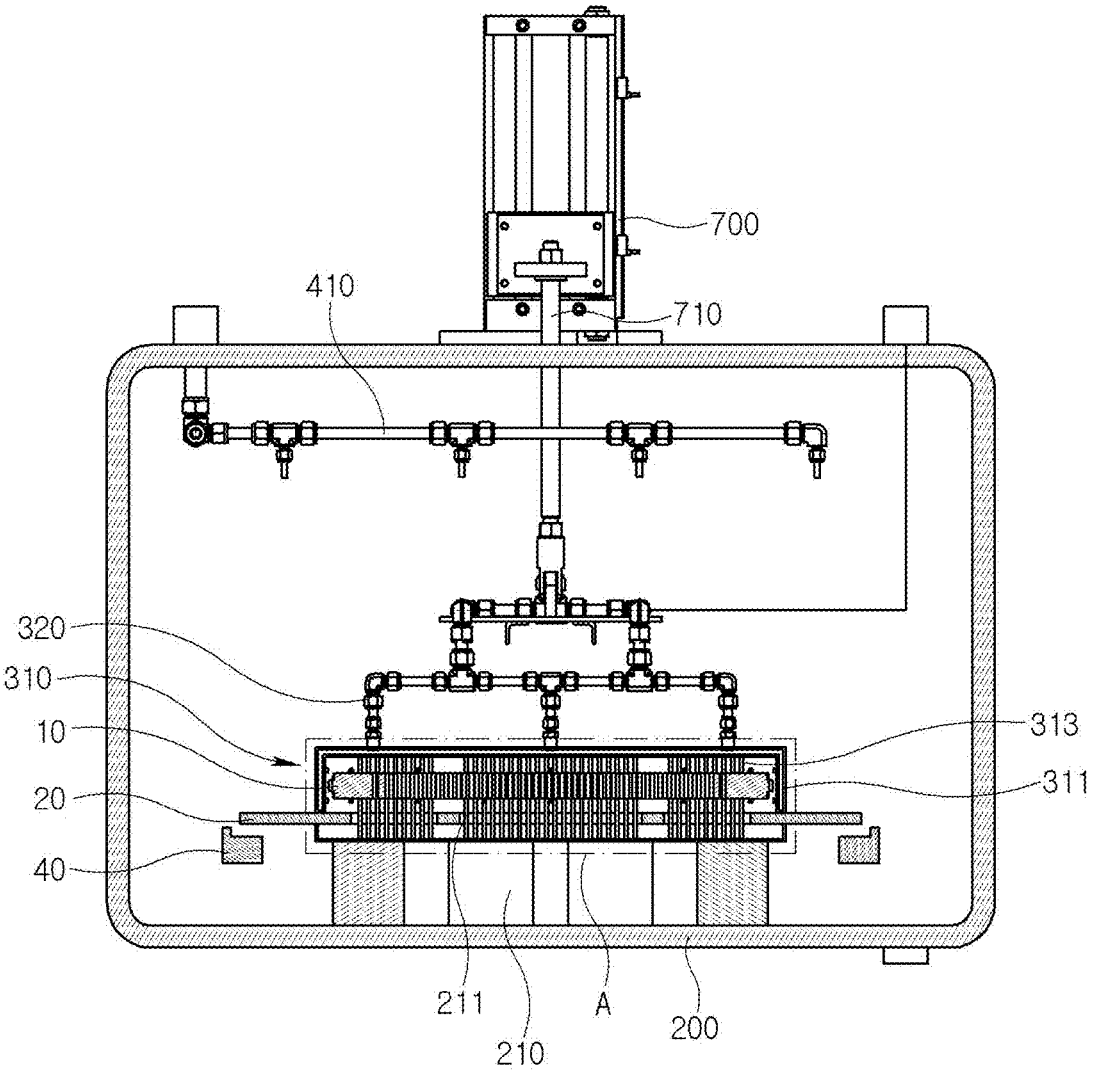

[FIG. 5]
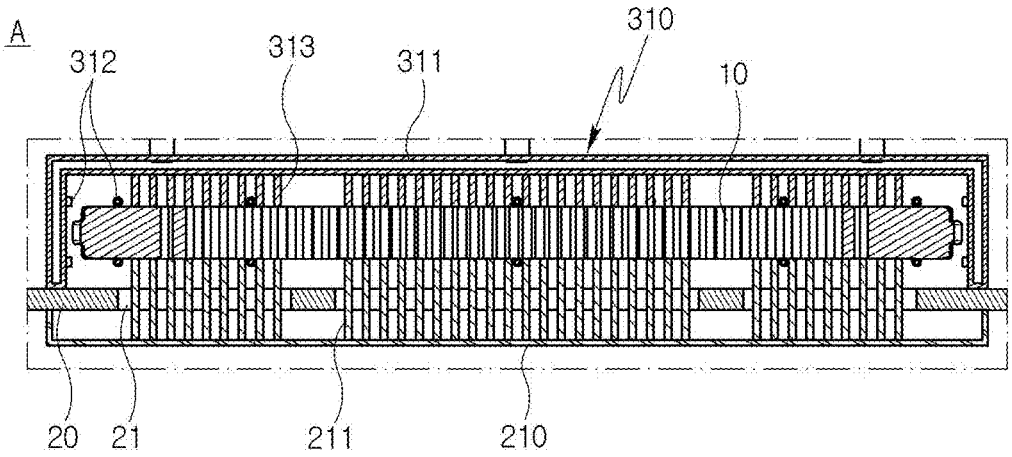

[FIG. 6]
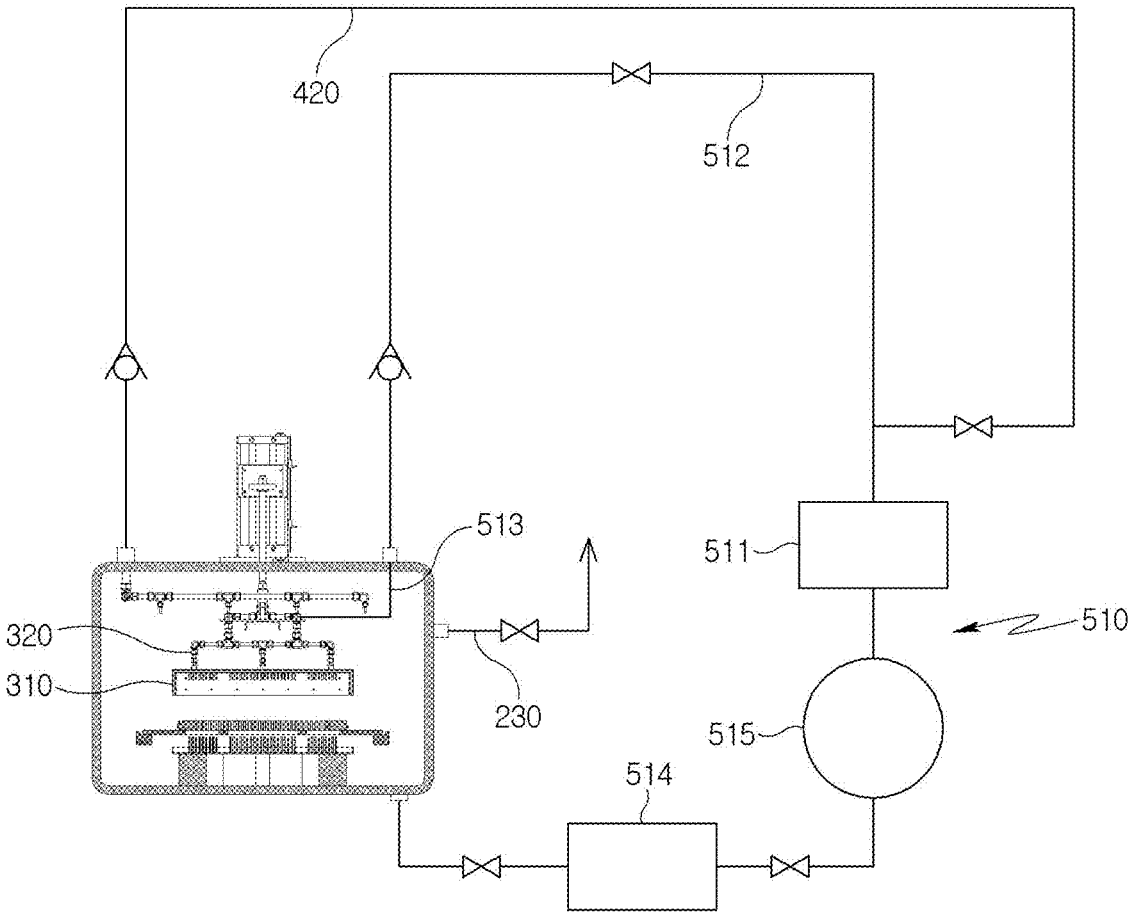

[FIG. 7]
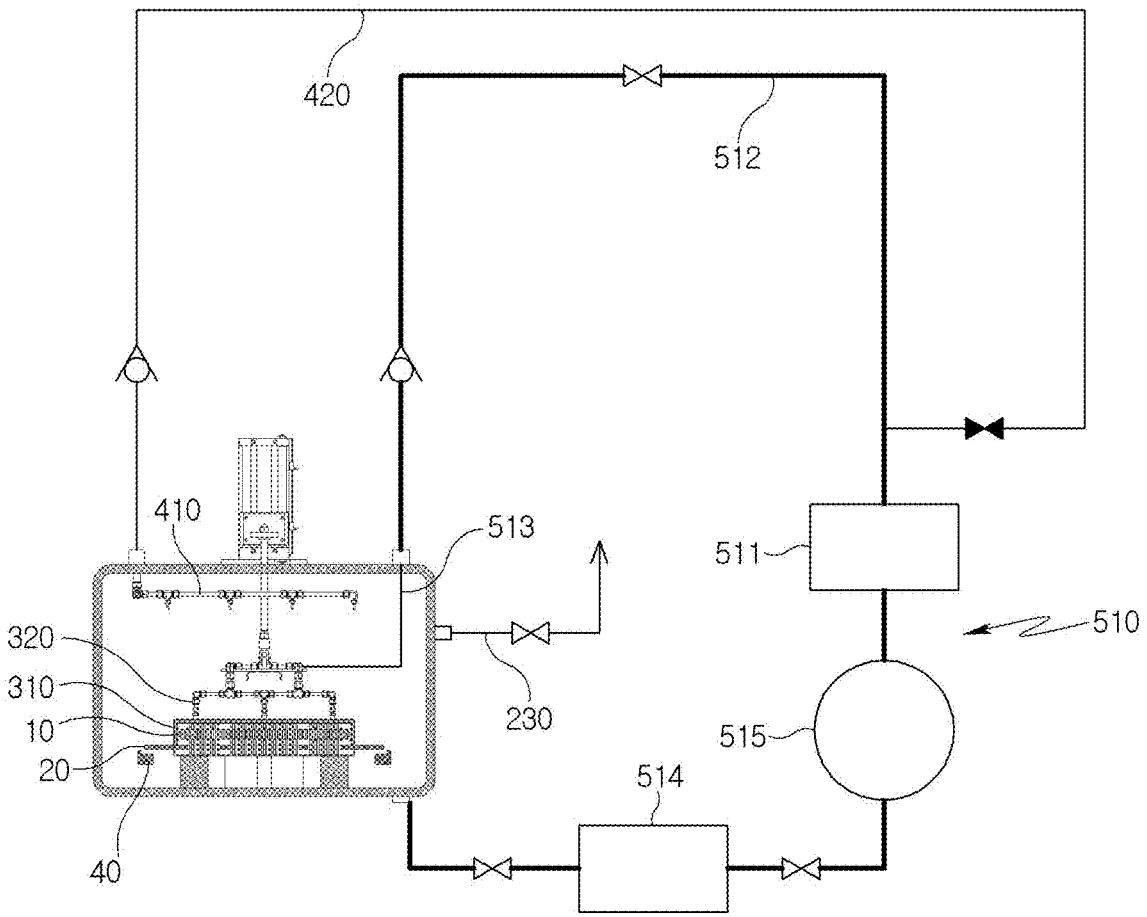

[FIG. 8]
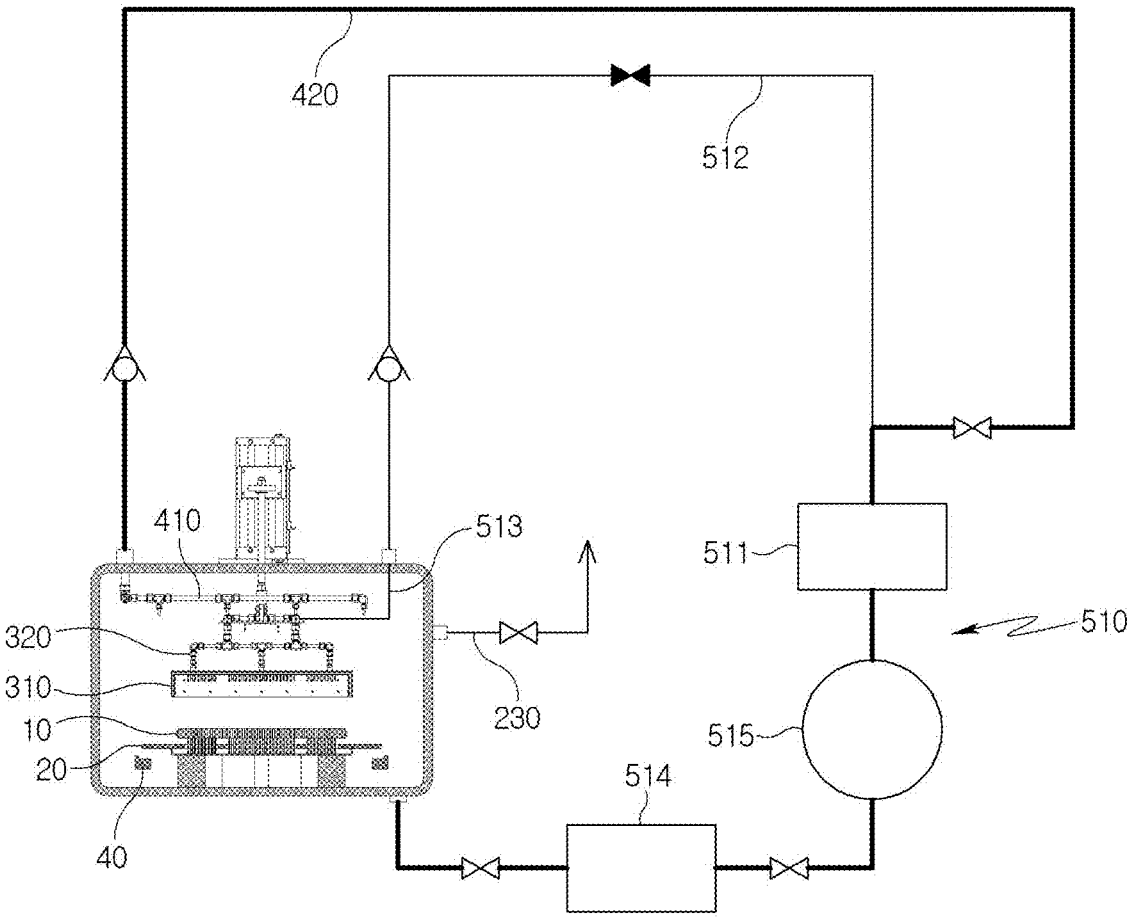

[FIG. 9]
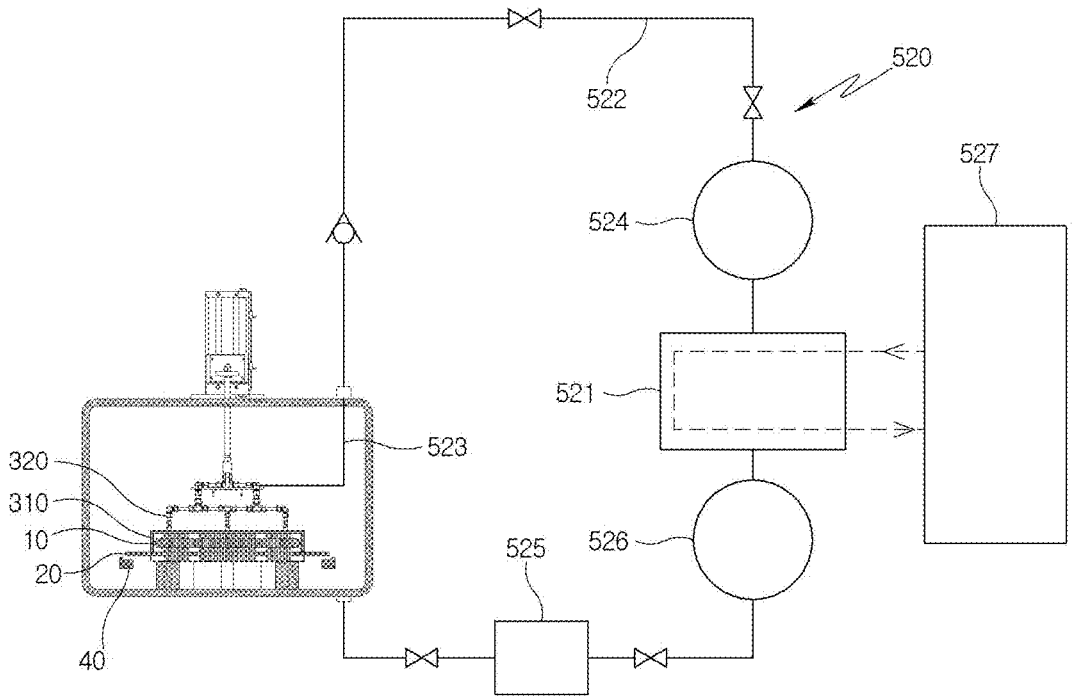

[FIG. 10]
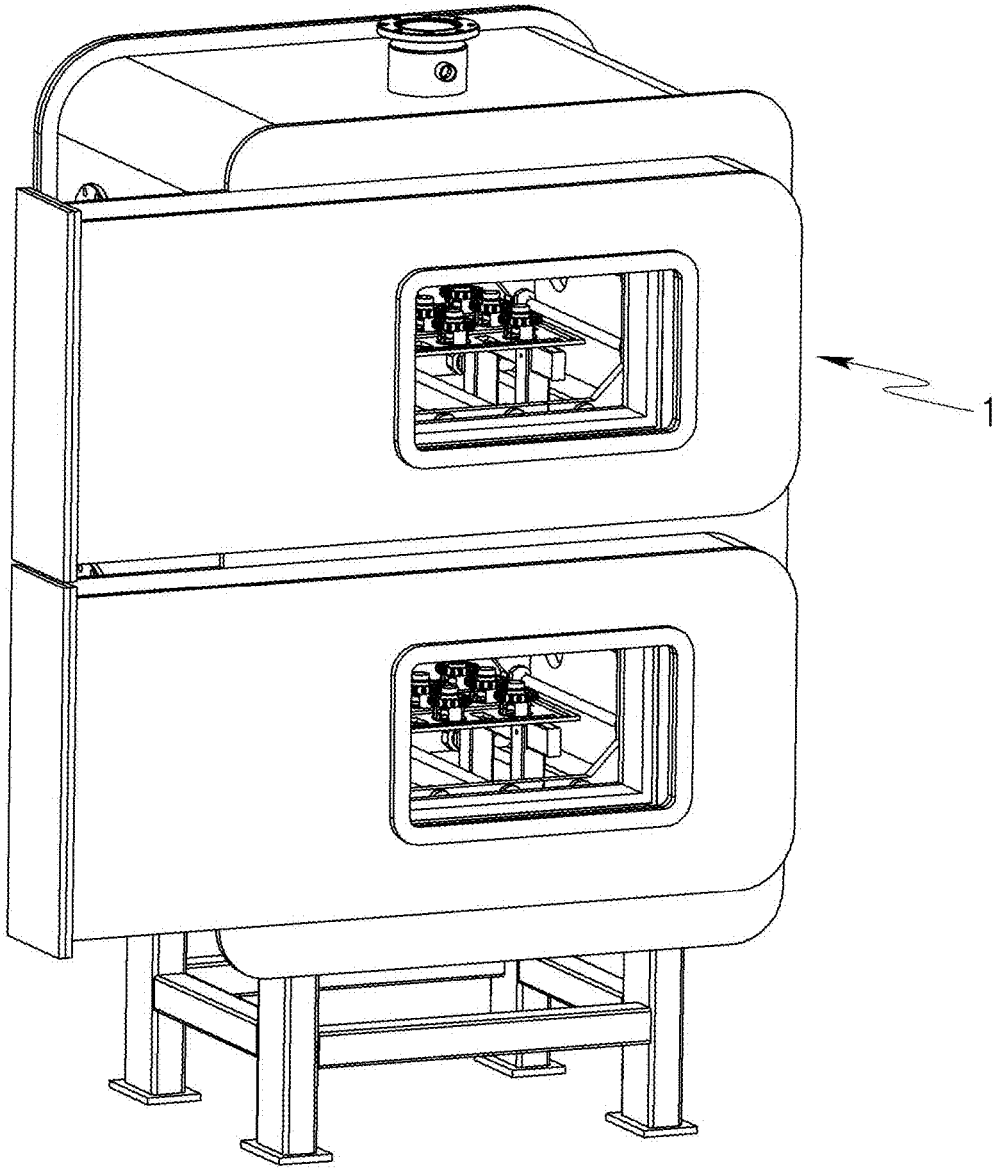

COOLING DEVICE FOR HEAT TREATMENT

CROSS-REFERENCE TO RELATED APPLICATIONS

The present application claims priority to Korean Patent Application No. 10-2022-0189887, filed Dec. 29, 2022, the entire contents of which is incorporated herein for all purposes by this reference.

FIELD

The present disclosure relates to a cooling device for heat treatment and more particularly to a cooling device for heat treatment that performs heat treatment by cooling individually or as a whole a heated metal object.

BACKGROUND

A cooling device for heat treatment of a metal product is used to control the mechanical properties of metal by using phase transformation characteristics of the metal product. The cooling device mainly uses oil or high-pressure gas fluids with excellent cooling capacity as a cooling medium for the purpose of rapid cooling of the product and cooling control of the product.

Recently, there is a trend to further use gas as a cooling medium in terms of environmental friendliness and ease of control of the cooling medium. However, there is a limit to performing overall uniform cooling control on a plurality of products that is loaded in the form of one or more tiers (hereinafter, loaded in the form of one tier is represented by 2D loaded, and loaded in the form of two or more is represented by 3D loaded), and a high-pressure gas supply line is required in order to obtain the cooling capacity.

Korean Patent No. 10-2302307 (hereinafter, referred to as "Patent Document 1") discloses a method and device for thermochemically hardening work pieces.

The Patent Document 1 discloses a device including two or more cementing chambers capable of heating a work piece by direct heat radiation, a cooling device, and a transfer system.

The Patent Document 1 discloses that the two or more cementing chambers, cooling device, and transfer system are capable of rapidly heating the work pieces and discloses a method for preventing serious thermal distortion of the work pieces by using 2D loading in which the work pieces are arranged side by side such that 30 to 100% of the surface of the work pieces can be heated by direct thermal radiation of a heating device in order to prevent complex post-machining due to serious thermal distortion of the 3D loaded work pieces.

Also, Korean Patent No. 10-2395488 (hereinafter, referred to as "Patent Document 2") discloses a multi-chamber furnace for vacuum carburizing and cooling of gears, shafts, rings and similar workpieces.

The multi-chamber furnace of the Patent Document 2 is arranged in a vacuum space, includes two or more process chambers (connected in parallel) according to continuous supply of individual workpieces arranged vertically or horizontally, an integrated transfer chamber with a loading and unloading system capable of cooperating with the individual process chambers through a door provided at the end of the process chamber, and equipment for gas cooling of the individual workpiece within a furnace operating cycle in an unloading lock. Also, the device for gas cooling of the individual workpiece includes a system of gas nozzles for pressing the cooling gas flow, and a two-part nozzle collector including a base. Disclosed is a method for minimizing thermal distortion when performing a heat treatment process on and cooling the individual workpiece through them mentioned above.

However, these conventional cooling devices have limited expandability depending on the shape of the product, or have a limited structure of the cooling chamber depending on the structural form of the heating chamber. Also, it is difficult to control the desired uniform cooling for various charging types considering the quantity and 3D loading of the products, etc.

SUMMARY

The present disclosure is designed to solve the above problems and has a purpose of providing a cooling device for heat treatment that performs heat treatment capable of obtaining a required cooling capacity by cooling individually or as a whole a heated metal object.

One embodiment is a cooling device for heat treatment. The cooling device for heat treatment may include: a chamber to which a plurality of objects is charged through one open side thereof; an individual cooling unit configured to be provided in the chamber, to individually cover the object, and to spray a cooling medium onto the object; and a driving unit configured to be provided on the chamber and to move the individual cooling unit in an up and down direction.

Here, the individual cooling unit may include: a cover configured to have one open side and a hollow interior formed therein in which the object is disposed; a cooling medium supply pipe configured to be installed on the driving unit, to move up and down, and to be fastened to the other side of the cover to supply the cooling medium to the interior of the cover; and a cooling medium supplier configured to be connected to the cooling medium supply pipe and to supply the cooling medium.

Also, the cover may include: a cover body configured to be formed in a box shape with one side open, to be formed in a double wall shape that allows the cooling medium to be introduced thereinto, and to have an outer wall that is in communication with the cooling medium supply pipe; and a nozzle configured to communicate with an inner wall of the cover body and to protrude inside the cover body to spray the cooling medium onto the object.

Also, the cover may include a plurality of pressing pins that is formed to protrude from an upper inner surface of the cover body and presses the object.

With this configuration, the plurality of objects is disposed on a jig tray, and the jig tray is charged to the chamber through a transfer jig and is seated on an object support portion provided in the chamber.

Here, the object support portion may include a plurality of support pins that passes through the jig tray and supports the object.

With this configuration, after the jig tray is lowered and the object is disposed to be spaced apart from the jig tray while being supported on the plurality of support pins, the cooling medium may be sprayed through the nozzle in a state where the object is pressed by the plurality of pressing pins by that the cover is lowered.

Also, the cooling medium supplier may include: a cooling medium storage tank that stores the cooling medium; a cooling medium supply line that connects the cooling medium storage tank and the chamber; and a flexible supply pipe that has one side end fastened to the chamber and connected to the cooling medium supply line and the other side end connected to the cooling medium supply pipe, and that has its length that varies in response to the movement of the cooling medium supply pipe.

For example, when the cooling medium is gas, the cooling medium supplier may include: a cooling medium collection tank that collects the cooling medium supplied to the chamber; and a cooling medium compressor that compresses the cooling medium stored in the cooling medium collection tank and supplies it to the cooling medium storage tank.

As another example, when the cooling medium is oil, the cooling medium supplier may include: a cooling medium supply pump that supplies the cooling medium stored in the cooling medium storage tank to the cooling medium supply pipe; a cooling medium collection tank that collects the cooling medium supplied to the chamber; a cooling medium return pump that supplies the cooling medium stored in the cooling medium collection tank to the cooling medium storage tank; and a cooling medium cooling unit that cools the oil stored in the cooling medium collection tank.

Also, when the cooling medium is gas, the cooling device for heat treatment may further include a common cooling unit that sprays the cooling medium onto the interior of the chamber.

More specifically, the common cooling unit may include: a common cooling medium spray nozzle that is provided within the chamber and sprays the cooling medium onto the interior of the chamber; and a common cooling medium supply line that connects the cooling medium storage tank and the common cooling medium spray nozzle.

BRIEF DESCRIPTION OF THE DRAWINGS

FIG. 1 is a perspective view showing schematically a cooling device for heat treatment according to an embodiment of the present disclosure;

FIG. 2 is a cross sectional view showing schematically the cooling device for heat treatment according to the embodiment of the present disclosure;

FIG. 3 is a cross sectional view showing schematically a state where an object is supported by a support pin in the cooling device for heat treatment according to the embodiment of the present disclosure;

FIG. 4 is a cross sectional view showing schematically a state where an individual cooling unit covers the object individually in the cooling device for heat treatment according to the embodiment of the present disclosure;

FIG. 5 is an enlarged view showing schematically a region "A" of FIG. 4;

FIG. 6 is a view showing schematically a state where components for supplying a cooling medium to a chamber are connected in the cooling device for heat treatment according to the embodiment of the present disclosure;

FIG. 7 is a view showing schematically a cooling medium supply line for individual cooling in the cooling device for heat treatment according to the embodiment of the present disclosure;

FIG. 8 is a view showing schematically a cooling medium supply line for common cooling in the cooling device for heat treatment according to the embodiment of the present disclosure;

FIG. 9 is a view showing schematically a configuration for supplying oil as the cooling medium to the chamber in the cooling device for heat treatment according to the embodiment of the present disclosure; and FIG. 10 is a perspective view showing schematically an example of a heating furnace that performs a heat treatment on the object.

DETAILED DESCRIPTION

Hereinafter, preferred embodiments of the present invention will be described in detail with reference to the accompanying drawings.

As the present invention can have various embodiments as well as can be diversely changed, specific embodiments will be illustrated in the drawings and described in detail. While the present invention is not limited to particular embodiments, all modification, equivalents and substitutes included in the spirit and scope of the present invention are understood to be included therein.

Terms used in the present specification are provided for description of only specific embodiments of the present invention, and not intended to be limiting. An expression of a singular form includes the expression of plural form thereof unless otherwise explicitly mentioned in the context.

Unless differently defined, all terms used herein including technical and scientific terms have the same meaning as commonly understood by one of ordinary skill in the art to which the present invention belongs. Terms, for example, commonly used terms defined in the dictionary, are to be construed to have exactly the same meaning as that of related technology in the context. As long as terms are not clearly defined in the present application, the terms should not be ideally or excessively construed as formal meaning.

Hereinafter, specific embodiments of the present invention will be described with reference to the accompanying drawings.

FIGS. 1 and 2 are perspective and cross-sectional views showing schematically a cooling device for heat treatment according to an embodiment of the present disclosure. FIGS. 3 and 4 are cross sectional views showing schematically a state where an individual cooling unit individually covers and presses an object in the cooling device for heat treatment. FIG. 5 is an enlarged view showing schematically a region "A" of FIG. 4. FIG. 6 is a view showing schematically a state where components for supplying a cooling medium to a chamber are connected in the cooling device for heat treatment. FIG. 7 is a view showing schematically a cooling medium supply line for individual cooling in the cooling device for heat treatment. FIG. 8 is a view showing schematically a cooling medium supply line for common cooling in the cooling device for heat treatment. FIG. 9 is a view showing schematically a configuration for supplying oil as the cooling medium to the chamber in the cooling device for heat treatment. FIG. 10 is a perspective view showing schematically an example of a heating furnace that performs a heat treatment on the object.

Referring to FIGS. 1 to 10, a cooling device 100 for heat treatment according to the embodiment of the present disclosure includes a chamber 200, an individual cooling unit 300, and a driving unit 700. A plurality of objects 10 is charged into the chamber 200 through one open side of the chamber. The individual cooling unit 300 individually covers the object 10 and sprays a cooling medium onto the object 10. The driving unit 700 is provided on the chamber 200 and moves the individual cooling unit 300 in an up and down direction.

Here, the chamber 200 is formed to have a hollow interior in which the plurality of objects 10 is seated and the individual cooling unit 300 for cooling the object 10 is provided. In addition, the chamber 200 is formed to have one open side such that the plurality of objects 10 can be charged to or withdrawn from the chamber. Of course, the one open side of the chamber 200 may be closed by a separate door portion (not shown).

As an example, the object 10 may be heat-treated in a heating furnace 1 shown in FIG. 10 and then may be charged to the chamber 200 through a transfer chamber. Here, the object 10 may be cooled while the transfer chamber is disposed in close contact with the open side of the chamber 200 and the open side of the chamber 200 is sealed, or alternatively, the object 10 may be cooled after the transfer chamber is separated from the chamber 200 and then the door portion closes the open side of the chamber 200.

Also, the plurality of objects 10 may be disposed on a jig tray 20, and the jig tray 20 may be charged to or withdrawn from the chamber 200 through a transfer jig 40 provided in the transfer chamber. Here, the transfer jig 40 may be composed of a telescope. That is, the transfer jig 40 may be configured such that the object 10 heated in the heating furnace 1 is withdrawn through the telescope provided in the transfer chamber, is charged to the transfer chamber, and is moved to the chamber 200 and then is charged to the chamber 200 again through the telescope.

Here, an object support portion 210 is provided on an inner bottom of the chamber 200. Therefore, the jig tray 20 is seated on the object support portion 210 and the object 10 is cooled. Of course, the object 10 may be cooled while the jig tray 20 is disposed on the transfer jig 40.

The individual cooling unit 300 individually covers the plurality of objects 10 charged to the chamber 200, and then sprays the cooling medium onto the objects 10 to individually cool the plurality of objects 10.

For this purpose, the individual cooling unit 300 may include a cover 310, a cooling medium supply pipe 320, and cooling medium suppliers 510 and 520. The cover 310 has one open side and a hollow interior formed therein in which the object 10 is disposed. The cooling medium supply pipe 320 is installed on the driving unit 700, moves up and down, is fastened to the other side of the cover 310, and supplies the cooling medium to the interior of the cover 310. The cooling medium suppliers 510 and 520 are connected to the cooling medium supply pipe 320 and supply the cooling medium.

That is, the individual cooling unit 300 is configured to supply the cooling medium to the interior of the cover 310 and to individually cool the objects 10, after the cover 310 individually covers the objects 10.

For example, a rack gear may be, as shown in FIG. 1, provided as the object 10. Here, the cover 310 may be formed in a shape that can receive the bar-shaped rack gear.

More specifically, the cover 310 includes a cover body 311 and a nozzle 312. The cover body 311 is formed in a box shape with one side open and is formed in a double wall shape that allows the cooling medium to be introduced thereinto. The outer wall of the cover body 311 is in communication with the cooling medium supply pipe 320. The nozzle 312 communicates with an inner wall of the cover body 311 and protrudes inside the cover body 311 to spray the cooling medium onto the object 10.

Here, the nozzle 312 is formed in plural numbers along a side surface of the inner peripheral surface of the cover body 311 so that the cooling medium is sprayed onto the object 10 provided inside the cover body 311.

Also, the cover 310 may further include a plurality of pressing pins 313 that is formed to protrude from an upper inner surface of the cover body 311 and presses the object 10. That is, when the object 10 is received within the cover 310, the pressing pin 313 presses the object 10.

Also, the object support portion 210 may further include a plurality of support pins 211 that passes through the jig tray 20 and supports the object 10. Here, the jig tray 20 is formed with a support pin through hole 21 that is formed in a portion where the support pin 211 is disposed and allows the support pin 211 is inserted thereinto.

With this configuration, when the jig tray 20 is lowered and the plurality of support pins 211 is inserted through the support pin through hole 21, the object 10 is, as shown in FIG. 3, disposed to be spaced apart from the jig tray 20, while being supported. Also, when the cover 310 is lowered and the object 10 is inserted into the cover 310, the object 10 is pressed by the plurality of pressing pins 313. That is, the object 10 is, as shown in FIG. 4, pressed by the plurality of support pins 211 and the plurality of pressing pins 313. Here, the cooling medium may be sprayed onto the object 10 through the nozzle 312, so that the object 10 is cooled. Since a rack gear is formed to be elongated, the rack gear may be twisted during the cooling of the object. Accordingly, in the present disclosure, the object 10 is cooled while being pressed by the plurality of support pins 211 and the plurality of pressing pins 313, so that the rack gear can be prevented from being twisted.

Through this, the cover 310 is disposed for each object 10, and thus, the object 10 can be individually cooled, so that all the objects can be cooled equally regardless of positions within the chamber 200 where the objects are disposed, and the object 10 can be cooled while being pressed. As a result, the cooling quality uniformity of the object 10 can be obtained.

Here, an actuator which is provided outside the chamber 200 and of which a linearly moving rod 710 passes through the chamber 200 may be provided as the driving unit 700.

Also, the cooling medium supply pipe 320 may be fastened to an end of the rod 710, may be connected in communication with a plurality of the covers 310, and may be connected to the cooling medium suppliers 510 and 520.

That is, the cooling medium supply pipe 320 has a hollow interior formed therein which allows the cooling medium to flow. When the cooling medium is supplied from the cooling medium suppliers 510 and 520, the cooling medium supply pipe 320 branches the cooling medium and supplies to each of the covers 310.

With this configuration, when the drive unit 700 operates and the rod 710 moves, the cooling medium supply pipe 320 and the cover 310 move together up and down in response thereto. When the cooling medium is supplied to the cooling medium suppliers 510 and 520 while the object 10 is disposed within the cover 310, the cooling medium is supplied to each of the plurality of covers 310 through the cooling medium supply pipe 320, so that the object 10 can be individually cooled.

Also, in the present disclosure, gas or oil may be used as the cooling medium that is supplied to the cover 310 and cools the object 10.

For example, when gas is used as the cooling medium, the cooling medium supplier 510 may include a cooling medium storage tank 511, a cooling medium supply line 512, and a flexible supply pipe 513. The cooling medium storage tank 511 stores the cooling medium. The cooling medium supply line 512 connects the cooling medium storage tank 511 and the chamber 200. One side end of the flexible supply pipe 513 is fastened to the chamber 200 and is connected to the cooling medium supply line 512, and the other side end is connected to the cooling medium supply pipe 320. The flexible supply pipe 513 has its length that varies in response to the movement of the cooling medium supply pipe 320.

Also, in order to collect the cooling medium supplied to the chamber 200, the cooling medium supplier 510 may include a cooling medium collection tank 514 and a cooling medium compressor 515. The cooling medium collection tank 514 collects the cooling medium supplied to the chamber 200. The cooling medium compressor 515 compresses the cooling medium stored in the cooling medium collection tank 514 and supplies it to the cooling medium storage tank 511. Additionally, the pipe that connects the components and allows the cooling medium to flow therethrough may be provided with a valve that opens and closes the pipe.

With this configuration, in a case where the object 10 is individually cooled through the cover 310, when the cooling medium stored in the cooling medium storage tank 511 is, as shown in FIG. 7, supplied, through the cooling medium supply line 512, to the flexible supply pipe 513 provided within the chamber 200, the cooling medium is supplied to the cover 310 through the cooling medium supply pipe 320 and the object 10 is cooled. In addition, the cooling medium which has cooled the object 10 may be collected to the cooling medium collection tank 514, may be compressed through the cooling medium compressor 515, and then may be supplied to the cooling medium storage tank 511 and may be collected.

Also, the chamber 200 may further include a vent 230 that discharges the cooling medium filled within the chamber to the outside.

In order to prevent the cooling medium under excessive pressure from flowing into the chamber 200, the vent 230 can operate to lower pressure inside the chamber 200 by being opened when the pressure exceeds a certain level.

Alternatively, the vent 230 may be opened at the beginning of supplying the cooling medium to the chamber 200 and may remain open until the interior of the chamber 200 is completely replaced with the cooling medium. Through this, it is possible to prevent gas or foreign substances other than the cooling medium from being mixed into the circulating cooling medium.

Also, when the cooling medium is gas, the cooling device 100 for heat treatment according to the embodiment of the present disclosure may further include a common cooling unit 400 that sprays the cooling medium onto the interior of the chamber 200.

That is, the common cooling unit 400 is not configured to directly spray the cooling medium onto each of the objects 10, but configured to spray the cooling medium onto the interior of the chamber 200, and thus to overall cool the object 10 provided within the chamber 200.

To this end, the common cooling unit 400 may include a common cooling medium spray nozzle 410 and a common cooling medium supply line 420. The common cooling medium spray nozzle 410 is provided within the chamber 200 and sprays the cooling medium onto the interior of the chamber 200. The common cooling medium supply line 420 connects the cooling medium storage tank 511 and the common cooling medium spray nozzle 410.

With this configuration, in a case where the cooling medium is sprayed onto the interior of the chamber 200, when the cooling medium supply line 512 is, as shown in FIG. 8, closed and the cooling medium stored in the cooling medium storage tank 511 is supplied through the common cooling medium supply line 420 to the common cooling medium spray nozzle 410 provided within the chamber 200, the cooling medium is sprayed onto the interior of the chamber 200 through the common cooling medium spray nozzle 410 and the object 10 is commonly cooled. Also, the cooling medium that has cooled the object 10 is collected to the cooling medium collection tank 514 and is compressed by the cooling medium compressor 515, and then is collected by being supplied to the cooling medium storage tank 511.

Also, the cooling medium supply pipe 320 may be configured to be separate from the rod 710 of the driving unit 700. That is, when the cooling is performed by spraying the cooling medium onto the interior of the chamber 200 through the common cooling unit 400, it may be intended that the cooling medium supply line 320 is separated from the rod 710 and the cooling medium is not interfered with by the cooling medium supply pipe 320 and the cover 310, and then the cooling medium is sprayed onto the interior of the chamber 200.

As another example, referring to FIG. 9, when oil is used as the cooling medium, the cooling medium supplier 520 may include, a cooling medium storage tank 521, a cooling medium supply line 522, a cooling medium supply pump 524, and a flexible supply pipe 523. The cooling medium storage tank 521 stores the cooling medium. The cooling medium supply line 522 connects the cooling medium storage tank 521 and the chamber 200. The cooling medium supply pump 524 supplies the cooling medium stored in the cooling medium storage tank 521 to the cooling medium supply pipe 320. One side end of the flexible supply pipe 523 is fastened to the chamber 200 and is connected to the cooling medium supply line 522, and the other side end is connected to the cooling medium supply pipe 320. The flexible supply pipe 523 has its length that varies in response to the movement of the cooling medium supply pipe 320.

Also, in order to collect the cooling medium supplied to the chamber 200, the cooling medium supplier 520 may include a cooling medium collection tank 525, a cooling medium return pump 526, and a cooling medium cooling unit 527. The cooling medium collection tank 525 collects the cooling medium supplied to the chamber 200. The cooling medium return pump 526 supplies the cooling medium stored in the cooling medium collection tank 525 to the cooling medium storage tank 521. The cooling medium cooling unit 527 cools the oil stored in the cooling medium collection tank 525. Here, a chiller may be provided as the cooling medium cooling unit 527.

With this configuration, in a case where oil is used as the cooling medium, when the cooling medium supply pump 524 operates, as shown in FIG. 9, and the cooling medium stored in the cooling medium storage tank 511 is supplied, through the cooling medium supply line 512, to the flexible supply pipe 513 provided within the chamber 200, the cooling medium is supplied to the cover 310 through the cooling medium supply pipe 320 and the object 10 is cooled. Also, the cooling medium which has cooled the object 10 may be collected to the cooling medium collection tank 514, and may be collected to the cooling medium storage tank 511 when the cooling medium return pump 526 operates. In addition, since the cooling medium collected to the cooling medium storage tank 511 is in a heated state, the cooling medium stored in the cooling medium storage tank 511 can be cooled through the cooling medium cooling unit 527.

According to the cooling device for heat treatment according to the embodiment of the present disclosure, it is possible to obtain a required cooling capacity by cooling individually or as a whole a heated metal object.

Also, according to the embodiment of the present disclosure, since the object can be separated from a base jig and then be cooled, the total amount of heat to be cooled is reduced, resulting in more rapid and effective cooling.

Also, according to the embodiment of the present disclosure, it is possible to cool the object while prevent thermal deform of the object by spraying a cooling medium while the object is being pressed.

Also, according to the embodiment of the present disclosure, since nitrogen gas or oil is used as the cooling medium, high-risk and high-cost gas such as hydrogen, helium, or the like is not used, and thus, it is possible to obtain an effect of reducing costs and preventing safety accidents.

Additionally, according to the embodiment of the present disclosure, a required cooling capacity is obtained by supplying the cooling medium at a sufficient flow rate even under low supply pressure conditions of the cooling medium, so that a desired cooling effect can be obtained.

Although the present invention has been described above by way of the specific embodiments, this is for describing the present invention in detail. The present invention is not limited thereto and it is clear that the present invention can be modified or improved within the spirit of the present invention by those of ordinary skill in the art.

All simple modifications or changes of the present invention fall within the scope of the present invention. The specific scope of protection of the present invention will be apparent by the appended claims.

REFERENCE NUMERALS

| | |
|---|---|
| 10: Object | 20: Jig Tray |
| 21: Support Pin Through Hole | 40: Transfer Jig |
| 100: Cooling Device for Heat Treatment | |
| 200: Chamber | |
| 210: Object Support Portion | 211: Support Pin |
| 300: Individual Cooling Unit | 310: Cover |
| 311: Cover Body | 312: Nozzle |
| 313: Pressing Pin | 320: Cooling Medium Supply Pipe |
| 400: Common Cooling Unit | |
| 410: Common Cooling Medium Spray Nozzle | |
| 420: Common Cooling Medium Supply Line | |
| 510: Cooling Medium Supplier | |
| 511: Storage Tank | 512: Cooling Medium Supply Line |
| 513: Flexible Supply Pipe | 514: Cooling Medium Collection Tank |
| 515: Cooling Medium Compressor | 520: Cooling Medium Supplier |
| 521: Storage Tank | 522: Cooling Medium Supply Line |

What is claimed is:

1. A cooling device for heat treatment, the cooling device comprising:

a chamber to which a plurality of objects is charged through one open side thereof;

an individual cooling unit configured to be provided in the chamber, to individually cover the object, and to spray a cooling medium onto the object; and a driving unit configured to be provided on the chamber and to move the individual cooling unit in an up and down direction.

2. The cooling device for heat treatment of claim 1, wherein the individual cooling unit comprises:

a cover configured to have one open side and a hollow interior formed therein in which the object is disposed;

a cooling medium supply pipe configured to be installed on the driving unit, to move up and down, and to be fastened to the other side of the cover to supply the cooling medium to the interior of the cover; and a cooling medium supplier configured to be connected to the cooling medium supply pipe and to supply the cooling medium.

3. The cooling device for heat treatment of claim 2, wherein the cover comprises:

a cover body configured to be formed in a box shape with one side open, to be formed in a double wall shape that allows the cooling medium to be introduced thereinto, and to have an outer wall that is in communication with the cooling medium supply pipe; and a nozzle configured to communicate with an inner wall of the cover body and to protrude inside the cover body to spray the cooling medium onto the object.

4. The cooling device for heat treatment of claim 3, wherein the cover comprises a plurality of pressing pins that is formed to protrude from an upper inner surface of the cover body and presses the object.

5. The cooling device for heat treatment of claim 4, wherein the plurality of objects is disposed on a jig tray, and wherein the jig tray is charged to the chamber through a transfer jig and is seated on an object support portion provided in the chamber.

6. The cooling device for heat treatment of claim 5, wherein the object support portion comprises a plurality of support pins that passes through the jig tray and supports the object.

7. The cooling device for heat treatment of claim 6, wherein after the jig tray is lowered and the object is disposed to be spaced apart from the jig tray while being supported on the plurality of support pins, the cooling medium is sprayed through the nozzle in a state where the object is pressed by the plurality of pressing pins by that the cover is lowered.

8. The cooling device for heat treatment of claim 2, wherein the cooling medium supplier comprises:

a cooling medium storage tank that stores the cooling medium;

a cooling medium supply line that connects the cooling medium storage tank and the chamber; and a flexible supply pipe that has one side end fastened to the chamber and connected to the cooling medium supply line and the other side end connected to the cooling medium supply pipe, and that has its length that varies in response to the movement of the cooling medium supply pipe.

9. The cooling device for heat treatment of claim 8, wherein, when the cooling medium is gas, the cooling medium supplier comprises:

a cooling medium collection tank that collects the cooling medium supplied to the chamber; and a cooling medium compressor that compresses the cooling medium stored in the cooling medium collection tank and supplies it to the cooling medium storage tank.

10. The cooling device for heat treatment of claim 8, wherein, when the cooling medium is oil, the cooling medium supplier comprises:

a cooling medium supply pump that supplies the cooling medium stored in the cooling medium storage tank to the cooling medium supply pipe;

a cooling medium collection tank that collects the cooling medium supplied to the chamber;

a cooling medium return pump that supplies the cooling medium stored in the cooling medium collection tank to the cooling medium storage tank; and a cooling medium cooling unit that cools the oil stored in the cooling medium collection tank.

11. The cooling device for heat treatment of claim 8, further comprising, when the cooling medium is gas, a common cooling unit that sprays the cooling medium onto the interior of the chamber.

12. The cooling device for heat treatment of claim 11, wherein the common cooling unit comprises:

a common cooling medium spray nozzle that is provided within the chamber and sprays the cooling medium onto the interior of the chamber; and a common cooling medium supply line that connects the cooling medium storage tank and the common cooling medium spray nozzle.

* * * * *